United States Patent [19]

Simon

[11] Patent Number: 4,982,592

[45] Date of Patent: Jan. 8, 1991

[54] METHOD OF EXTRUDING CHANNELED SLEEVES

[76] Inventor: Joseph A. Simon, 30855 Little Mack Ave., Boseville, Mich. 48066

[21] Appl. No.: 490,281

[22] Filed: Mar. 8, 1990

[51] Int. Cl.[5] ..... B21C 23/10; B21C 25/04

[52] U.S. Cl. ..... 72/260; 72/266; 72/370

[58] Field of Search ..... 72/260, 266, 264, 265, 72/370

[56] References Cited

U.S. PATENT DOCUMENTS

| | | | |
|---|---|---|---|
| 3,886,649 | 6/1975 | Simon | 228/112 |
| 3,942,728 | 6/1980 | Hilton | 72/260 |
| 3,948,073 | 4/1976 | Lovell | 72/266 |
| 4,292,831 | 10/1981 | Simon | 72/266 |

FOREIGN PATENT DOCUMENTS

| | | | |
|---|---|---|---|
| 163053 | 5/1964 | U.S.S.R. | 72/260 |
| 537728 | 12/1976 | U.S.S.R. | 72/264 |
| 7420 | of 1901 | United Kingdom | 72/266 |

*Primary Examiner*—Robert L. Spruill

*Attorney, Agent, or Firm*—Harness, Dickey & Pierce

[57] ABSTRACT

A metal tube, such as a valve body sleeve, is cold extruded to form full length and partial length longitudinal channels in its interior wall surface. The channeled tube is formed by extruding a metal, tubular blank, through an open ended die having an extrusion die throat at one end. A punch is inserted in the die and bears against an end of the blank for pushing the blank longitudinally through the die throat. The punch has an extension, having a leading edge section and a trailing edge section that pass through the blank. Longitudinally extending teeth are formed on the two sections, with some of the teeth being continuously longitudinally aligned and others being located only on the trailing section. Initially, the leading section is arranged within the die throat and the leading end portion of the blank is extruded through the die throat, around the extension leading section to form channels therein. Then, the punch trailing section is within the die throat as the punch continuously pushes the blank through the die throat so as to continue the formation of the channels started by the leading sections while simultaneously forming channels in the intermediate portion of the blank. Then, the punch is removed, a new blank is inserted against the first blank, and the punch is replaced for pushing the second blank, and thereby, the first blank through the die throat while the punch leading section is positioned within the die throat so as to continue the formation of full length channels while discontinuing the formation of partial channels within the intermediate portion of the blank.

7 Claims, 2 Drawing Sheets

METHOD OF EXTRUDING CHANNELED SLEEVES

BACKGROUND OF INVENTION

This invention relates to a method for extruding metal tubes to form full length and partial length longitudinal grooves within the interior wall of the tube so that the tube may be used, for example, for valve body sleeves for controlling oil flow in vehicle steering mechanisms and for other articles.

In the past, the manufacture of metal tubes with full length and partial length grooves or channels formed within the interior of the tubes has been difficult and relatively expensive. An example of this type of product is an automotive vehicle valve body or sleeve which forms part of a valve which controls the flow of oil in the vehicle steering mechanism. Such a valve body or sleeve is formed of a metal tube which has, for example, four full length channels extending longitudinally through its interior surface. In addition, it may have, for example, four partial length channels which are located only in the intermediate portion of the sleeve. That is, these partial length channels terminate a considerable distance from the opposite ends of the sleeve.

In the past, these sleeves have been manufactured by broaching the number of channels that are required along the full length of the interior of the tube. Then the opposite ends of the partial channels were blocked off.

One way that has been used in the past to block off the ends of the partial channels involved, first, forming the partial channels of a shallower depth than the full length channels. Then, the opposite ends of the interior wall surface of the tube were cut away to the depth of the shallower partial channels. Next, rings were fitted within the cut-away end portions so that each of the rings blocked off one of the opposite ends of the shallower, partial channels. Meanwhile, the rings overlapped the end portions, which were not cut away, of the full length channels. Because of the rings, the opposite, overlapped end portions of the full length channels were of shallower depth than their middle parts. However, the full length channels extended continuously to the opposite ends of the tube.

By the foregoing method, a number of partial and full length channels were provided within an article, such as a valve body sleeve. These channels were then communicated either with each other or to other places by means of drilling holes in the sleeve. In the case of a valve body sleeve an interior spool was inserted within the tubular sleeve. Thus, by appropriate endwith or rotative motion the flow of oil was controlled through the various full length and partial length channels.

In this type of valve construction, the valve body or sleeve requires considerable machining and also, requires three separate parts which must be assembled.

In the past, cold forming processes for extruding thin wall metal tubes either cold or with some heat, have been available. Examples of these cold forming extrusion processes are illustrated, for example, in my prior U.S. Pat. No. 4,277,969 issued July 14, 1981 for a method of cold forming tubes with interior thicker wall sections, and No. 4,292,831 issued Oct. 6, 1981 for a process for extruding a metal tube with inwardly thickened end portions. Other examples of such cold forming processes are disclosed in my U.S. Pat. Nos. 3,837,205 issued Sept. 24, 1974 for a process for cold forming a metal tube with an inwardly thickened end, U. S. Pat. No. 3,886,649 issued June 3, 1975 for a process for cold forming a metal tube with an inwardly thickened end, U.S. Pat. No. 4,301,672 issued Nov. 24, 1981 for a process for forming semi-float axle tubes and the like, U.S. Pat. No. 4,487,357 issued Dec. 11, 1984 for a method for forming well drill tubing and U.S. Pat. No. 4,435,972 issued Mar. 13, 1984 for a process for forming integral spindle-axle tubes.

The cold extrusion processes disclosed in the above-mentioned patents are relatively inexpensive in mass production manufacture of metal, tubular parts. Thus, the invention of this present application relates to utilizing a cold extrusion process, but adapting such a process for the production of tubes having some full length and some partial length grooves or channels formed in their interiors so as to produce parts such as the valve body sleeves and the like less expensively.

SUMMARY OF INVENTION

This invention contemplates forming a thin wall metal tube, such as a sleeve, by cold or substantially cold extrusion which forms, in one extrusion operation, both full length and partial length grooves or channels within the interior wall of the tube. The equipment utilized generally includes an open ended die having one open end and a constricted extrusion die throat at the opposite end. A punch having a punch body slidably fits into the die open end. The punch includes an elongated extension divided into a leading end portion and a trailing end portion which slide through the die throat as the punch is advanced towards the throat. A number of radially outwardly extending, continuous teeth are formed on the punch leading section and these teeth continue along the length of the punch trailing section. In addition, separate teeth are formed on the punch trailing section only.

The process of this invention contemplates inserting a tubular metal blank, such as a steel material, into the open end of the die and inserting the punch within the die, with its extension passing through the center of the blank. The punch is advanced towards the throat while the punch leading section is located within the die throat so that the metal is cold flowed inwardly, due to the constricted die throat, around the punch leading section. That sizes the leading portion of the blank and the teeth form channels within the blank.

Thereafter, continued movement of the punch locates the punch trailing section within the die throat so that the metal tube cold flows inwardly around that section to continue the formation of the channels and, also, to form intermediate or partial channels within the middle portion of the blank. Then, the punch is removed, and a new blank is placed upon the first blank which still has a portion remaining within the die throat. Continued movement of the punch, at this point, presses the second blank which, in turn, presses the first blank through the die throat and causes its trailing end portion to cold flow inwardly around the punch extension lead section to continue the formation of the full length channels while discontinuing forming the partial channels. As a result, when the extruded blank, now a sleeve or finished tube, exits from the die throat, it is provided with some continuous channels extending its full length and some partial channels located only in its middle portions. That sleeve is then ready for any finish machining and drilling required to complete the construction of a valve body sleeve.

Significantly, the invention contemplates forming, in one pass through the die, a tubular part which is simultaneously provided with some full length and some partial length grooves or channels. These may be of different depths or widths as desired. Thereby, this eliminates the prior methods using more expensive machining and additional parts to form such an article.

Another object of this invention is to inexpensively form a metal tube or sleeve with a number of continuous and discontinuous channels, which may be of different depths and widths, wherein the metal receives the metallurgical improvements resulting from cold extrusion and, conversely, stresses and other metallurgical problems resulting from machining are eliminated.

Still a further object of this invention is to provide a method for forming tubes or sleeves with continuous and discontinuous channels by a single pass extrusion and, thereby, eliminate considerable hand labor and machining procedures for producing such a part.

These and other objects and advantages of this invention will become apparent upon reading the following description, of which the attached drawings form a part.

DETAILED DESCRIPTION

Figure 1:
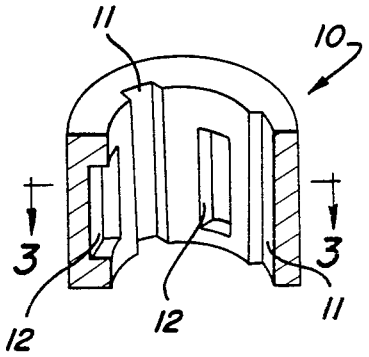
FIG. 1 is a cross sectional, perspective view of an extruded valve body sleeve with full length channels and partial length channels.
Figure 2:
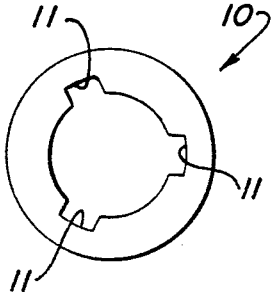
FIG. 2 is a top, plan view of the sleeve.
Figure 3:
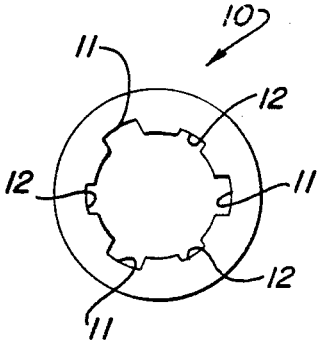
FIG. 3 is a cross sectional view taken in the direction of arrows 3—3 of FIG. 2.

FIG. 1 illustrates, in cross sectional perspective, a valve body or sleeve 10 useful as part of an oil control valve for automotive vehicle steering mechanisms. The sleeve is formed of a suitable metal, such as a suitable steel selected for the particular purpose. It is provided with a number of full length channels or grooves 12 and a number of partial length channels or grooves 13 which are located in the intermediate portions of the tubular sleeve. That is, the partial length channels terminate a distance from the opposite ends of the sleeve.

The valve body or sleeve 10 is provided with drilled holes and its interior face may be ground for smoothness and dimensional precision. A suitable valve spool is positioned within the sleeve and by rotating or axially moving the spool, depending on the type of valve involved, the flow of oil may be controlled through the valve. The details and construction of the valve itself, forms no part of this invention and therefore is omitted. This invention is concerned with the formation of some full length and some partial length grooves within the interior surface of the sleeve. Moreover, although the invention is described in connection with a particular type of valve body or sleeve, this invention is applicable to and contemplates other tubular constructions which require different length and/or different depth internal channels formed upon its interior surface.

Figure 7:
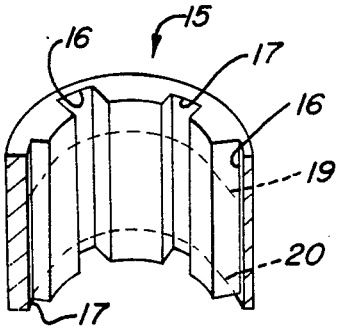
Fig-7 PRIOR ART
FIG. 7 is a perspective, cross sectional view of a prior art blank with broached channels.
Figure 8:
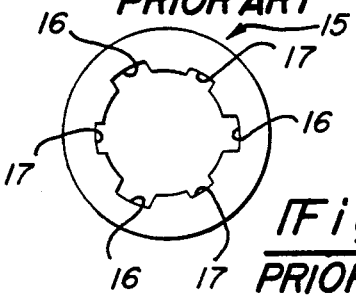
Fig-8 PRIOR ART
FIG. 8 is a top, plan view of the prior art blank of FIG. 7.

With regard to tubular sleeves useful for valve bodies, FIGS. 7–8 schematically illustrate the prior art method for manufacturing sleeves or tubes having full length and partial length grooves formed therein. Thus, FIG. 7 illustrates a sleeve forming blank 15 which is provided with a number of broached deep channels 16 and broached shallow channels 17 extending along its full length. The broaching of the deep and shallow channels may be performed at one time, using an appropriate broach for that purpose and producing the number of channels desired. For example, there may be three deep and three shallow channels or four deep and four shallow channels, etc., depending upon the requirements.

Figure 9:
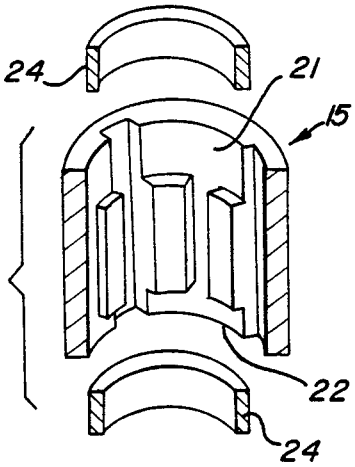
Fig-9 PRIOR ART
FIG. 9 is a cross sectional, perspective view showing the steps involved in blocking the ends of the partial or intermediate channels in the prior art blank.

After the channels are broached in the sleeve blank, the opposite ends of the blank are machined to the depth of the upper line 19 and lower line 20, inwardly from the opposite ends of the blank, and to the depth of the shallow channels 17. Thus, as illustrated in FIG. 9, an upper, annular socket 21 is formed at one end of the blank and a corresponding lower, annular socket 22 is formed at the opposite end of the blank.

Figure 10:
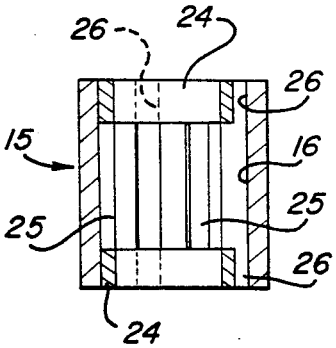
Fig-10 PRIOR ART
FIG. 10 is a cross sectional, elevational view showing a completed prior art sleeve.

Rings 34 are force fitted and secured within the upper and lower sockets 21 and 22 to block the opposite ends of the shallow channel. These rings have a wall thickness corresponding to the depth of the shallow channels. Consequently, because of the opposite rings, partial length channels 25 are formed in the intermediate portions of the blank, as shown in FIG. 10. Simultaneously, the deeper, broached channels 17 have opposite ends channel portions 26 which are overlapped by the rings. Nevertheless, these end portions communicate such channels to the opposite ends of the sleeve to form full length channels or grooves. In that manner, full length channels and partial channels, located in the middle portions of the sleeve, were produced.

The prior art method for forming the full length and partial length channels is relatively expensive and requires three parts, and considerable machining of the sleeve blank. The method of the present application contemplates eliminating the prior art method and utilizing a single part in the form of a single blank which is extruded to produce corresponding full length and partial length channels by extrusion.

Figure 4:
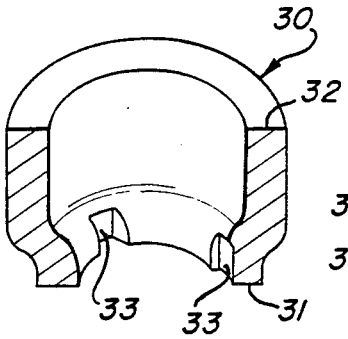
FIG. 4 is a cross sectional, perspective, view showing the extrusion of the leading edge portion of the blank from which the sleeve is extruded.
Figure 5:
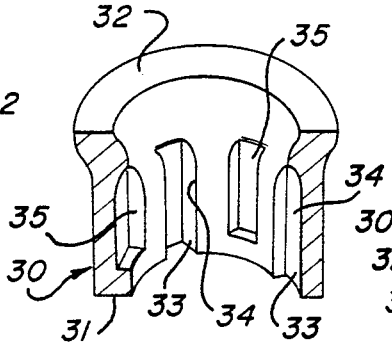
FIG. 5 is a cross sectional view, in perspective, showing a continuation of the extrusion through the intermediate portion of the blank.
Figure 6:
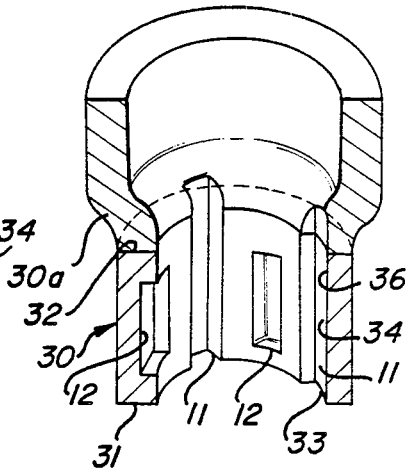
FIG. 6 illustrates, in perspective cross section, the completion of the extrusion of a first blank with a second, partially extruded blank, pushing against the first blank.

FIGS. 4–6 generally illustrate the extrusion process of this invention. The process begins with a tubular metal blank 30 having a leading end portion 31 and a trailing end portion 32. Initially, the leading end portion is extruded to form channels or groove portions 33 therein, as shown in FIG. 4. Then, the extrusion process continues and forms intermediate channel portions 34 which are continuations of the channel leading end portions 33. Simultaneously, intermediate channel portions 35 are extruded within the intermediate portion or central portion of the blank, as illustrated in FIG. 5.

Next, trailing end channel portions 36 are formed in the tubular blank. This is accomplished by utilizing a second blank 30*a* (see FIG. 6) to push the first blank 30 through the extrusion die. This forms the continuation trailing end channel portion 36 and the initiation of the leading edge channel portion 31 in the second blank, as illustrated in FIG. 6. Generally, the extrusion process involves squeezing radially inwardly and longitudinally, successive portions of the tubular metal blank. This squeezing and flow of the metal causes the metal to flow around an internal mandrel and through an external die throat which sizes and shapes the blank into the required sleeve and, simultaneously, forms the required grooves. The extrusion is performed at room temperature or slightly elevated temperatures. Thus, it can be referred to as cold forming or cold extrusion.

The extrusion process is schematically illustrated, step by step, in FIGS. 11–21.

Figure 11:
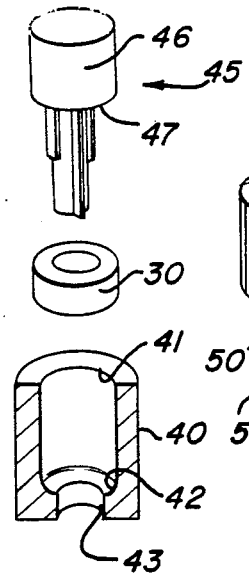
FIG. 11 is a perspective, partially cross sectional, schematic view illustrating the alignment of a punch, tubular blank and open ended extrusion die.
Figure 12:
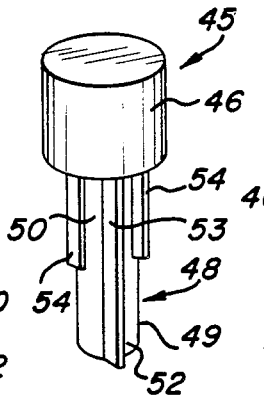
FIG. 12 is a perspective elevational view, schematically showing a punch.
Figure 22:
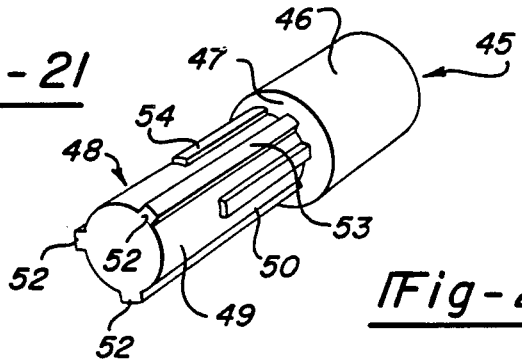
FIG. 22 is a perspective view of the punch, emphasizing the lead and trailing sections of the punch extension.

FIG. 11 shows a schematic, perspective, cross sectional view of an open ended die 40 having an entry or loading end 41. The die includes an exit end formed by a radially inwardly arranged, annular shoulder 42 which defines a constricted die throat 43 through which metal is extruded. The tubular metal blank 3 is dropped into the entry end 41 of the die 40. Then, a punch 45 is inserted in the die and blank. The punch 45 includes a punch body portion 46 which closely fits into the die 40 for sliding longitudinally in the die. The punch has an annular shoulder 47, which is illustrated in FIG. 22, for pushing against the trailing end of the blank. In addition, the punch has a mandrel-like extension 48 which extends through the blank and the die throat.

The punch extension 48 includes a leading section 49 and a trailing section 50, whose respective lengths may vary, depending upon the length and shape of the extruded part. Longitudinally arranged teeth 52 are formed on the lead section. These teeth have continuing portions 53 along the trailing section which are aligned with and form unitary teeth with the teeth portion 52. In addition, longitudinally arranged teeth 54 are formed only on the trailing section. The number of teeth and the height of these teeth radially measured from the axis of the punch extension, may be varied, depending upon the requirements of the finished part. Thus, the teeth may all be of the same height or may be of different heights or the continuous teeth 52–53 may all be of one height while the trailing section teeth 54 may be of a different height.

Figure 13:
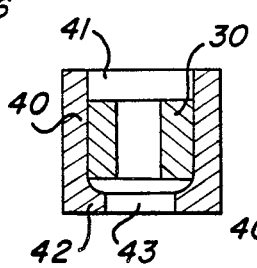
FIGS. 13–21 illustrate the successive steps in extruding the blank to produce the full length and partial length channels therein.

The extension process begins with placing a tubular blank 30 within the open ended die 40 through the entry end 41 of the die, as illustrated in FIG. 13. The die and the punch may be mounted within suitable, commercially available presses which move the punch longitudinally towards the die throat or, conversely, hold the punch stationary and move the die around the punch. Thus, the punch and die are moved relative to each other. For illustration purposes, the punch is shown as the moving element while the die is shown as the stationary element in this process.

Figure 14:
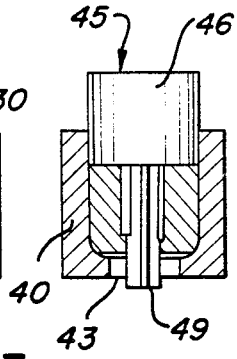

After the blank is inserted in the die, the punch is placed within the die, shown in FIG. 14, with its extension passing through the center of the blank and with its extension leading section 49 located within the die throat. At this point, the punch is longitudinally moved so that its angular shoulder 47 pushes the blank towards and through the die throat around the punch extension 48.

Figure 15:
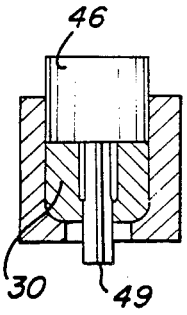

FIG. 15 illustrates the leading end portion of the blank extruding through the die throat, around the punch leading section 49. That produces the channel or groove portion 33 in the lead end portion, which is illustrated in FIG. 4.

Figure 16:
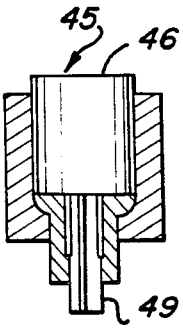
Figure 17:
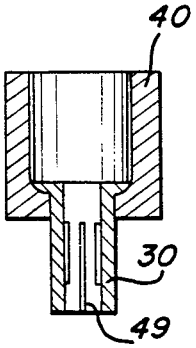
Figure 18:
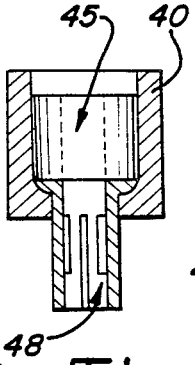
Figure 19:
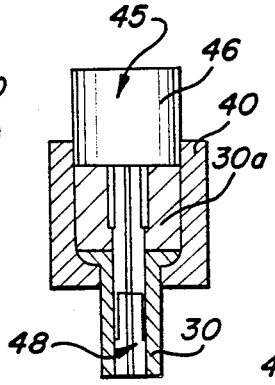
Figure 20:
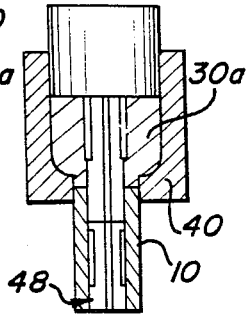

Continuation of the movement of the punch, as illustrated in FIG. 16, moves the punch trailing section 50 in the area of the die throat so that the channel portions 34, which are continuations of the channel portions 33, are formed and, also, the intermediate channel portions 35 are formed. This continues, as shown in FIG. 17, at which point the intermediate portion of the blank has been extruded, leaving the trailing end portion of the blank incomplete. Thus, as shown in FIG. 17, the punch is removed. A second blank 30A is inserted in the entry end 41 of the die 40, against the upper or trailing end portion 31 of the first tubular blank 30, as illustrated in FIG. 18. Next, the punch is replaced, as shown in FIG. 19, so that its leading section 49 is within the die throat area. The punch is now advanced to complete the extrusion of the initial blank 30 and to form the trailing end channel portions 3 which complete the full length or through channels. Simultaneously, the leading end channel portions 33 are formed in the second blank 30, as illustrated in FIG. 20 and FIG. 6.

Figure 21:
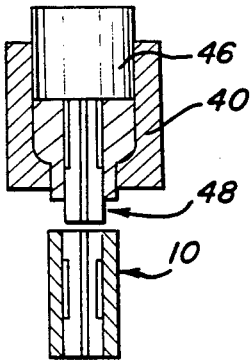

The second blank, as it is extruded through the die throat, pushes the first blank clear of the die, as illustrated in FIG. 21. This completes the extrusion of the sleeve with the full length channels and partial length channels located in the intermediate or middle portions of the sleeve. The process is repeated to successively extrude one blank after another.

The lengths of the extruded sleeves or tubes and the widths and depths and number of channels or grooves extruded can be varied by varying the sizes of the blanks and the sizes of the punches, punch extensions, teeth on the punch extensions, etc. The variations can be designed by those skilled in the art, depending upon their requirements for the finished product. In addition, it is possible to have some channels begin as intermediate or partial channels, starting at a distance from the leading end of the blank, and continuing to the opposite or trailing end of the blank, while other channels may be confined within the intermediate or middle portions of the blank. As can be seen, the process permits a number of variations in the extruded product. Significantly, the blanks may be extruded into sleeves with the varying types of channels formed during the extrusion process which considerably reduces the cost of making such parts through broaching or other machining operations that have been used in the past. Moreover, the extrusion process usually produces better metallurgical characteristics of the part so that, in essence, a less expensive and better part is produced by this process.

This invention may be further developed within the scope of the following claims. Thus, the foregoing description should be read as illustrative of an operative embodiment of this invention.

Having fully described an operative embodiment of this invention, I now claim:

1. A process for extruding a thin wall, tubular metal sleeve having an interior wall surface with at least one full length channel formed in, and extending along the full length of, its interior wall surface and at least one other, partial length channel formed in and extending along the wall surface and spaced inwardly a distance from the opposite ends of the sleeve, comprising:

placing a short, tubular metal blank having a leading end portion and a trailing end portion and an intermediate portion between the end portions, within an open ended tubular die having an entry end through which the blank is placed, and an opposite exit end formed as an annular, radially inwardly extending, continuous shoulder surrounding an exit opening defining a die extrusion throat through which the blank is longitudinal extruded;

inserting a punch into the die entry end, with a punch having a body portion that is closely fitted within the die for axially directed movement relative to the die throat and with an annular shoulder for engaging against the trailing end of the blank, that is, the end nearest the die entry end, and with the punch being provided with an axially extending extension portion having a leading end section and a trailing end section, and with at least one elongated longitudinally extending tooth formed on the leading section and at least two longitudinally extending teeth formed on the extension trailing section, and the tooth on the leading section being longitudinally aligned with one of the teeth on the trailing section;

positioning the punch leading extension section within the die throat and within the blank leading end portion;

moving the punch towards the die throat to push the blank leading end portion through the die throat, around the punch leading end section, and with the cross section of the die throat being smaller than the cross section of the blank, so as to sequentially collapse the blank leading end portion around the extension leading end section so that the leading end section tooth forms a channel extending longitudinally of the blank inner wall surface;

next, moving the punch trailing end section within the die throat area and moving the punch towards the die throat so that the blank intermediate portion passes through the throat and around the punch extension trailing end section to continue forming the channel that was formed by the punch extension leading end tooth while also forming a separate channel in the blank intermediate portion;

removing the punch and placing a second blank within the die, with its leading end portion arranged against the trailing end portion of the first mentioned blank;

repositioning the punch within the die with its leading end section positioned within the die throat area and within the trailing end portion of the first mentioned blank and moving the punch towards the die throat so that its shoulder pushes the second blank which, thereby, pushes the first mentioned blank completely through the die throat to form a continuation of the longitudinally aligned channels formed in the blank leading edge portion and intermediate portion and for discontinuing the formation of the second, partial channel, formed in the blank intermediate portion; and whereby a continuous longitudinal channel extending the length of the sleeve and a longitudinally extending, partial channel located entirely within the intermediate portion of the sleeve are produced.

2. A process as defined in claim 1, and including the punch extension leading section being formed with a number of teeth and the punch extension trailing section being formed with a larger number of teeth, and with some of the teeth in each section being longitudinally aligned, and forming a number of full and partial channels simultaneously.

3. A process as defined in claim 2, and each tooth formed on the leading end section being continuous, end to end, with a corresponding tooth found on the trailing section for forming a full length channel in the blank.

4. A process as defined in claim 3, and including forming the channels in predetermined, different depths for the different channels by preforming the teeth of predetermined, different heights, measured radially outwardly, so that some of the teeth are higher and, thereby, form channels of greater depth than other of the teeth.

5. A process as defined in claim 4, and including forming the full length channels all of the same depth and forming the partial channels all of the same depth, but of a different depth than the full length channels.

6. A process for making a thin wall, valve body sleeve with at least one full length channel and at least one partial length channel, which terminates a distance from the opposite ends of the sleeve, in the interior wall surface of the sleeve, comprising the steps of:

providing an open ended tubular die having an entry end and an opposite exit end formed as an annular radially inwardly extending continuous shoulder surrounding an exit opening which defines a die extrusion throat, and providing a punch having a body portion sized to closely fit into the die, through the die entry end, with the punch being provided with a punch extension divided into a leading section and a trailing section, and each section having radially outwardly directed teeth formed thereon, with each tooth on the leading section being longitudinally aligned with a tooth on the trailing section, and with at least one additional tooth formed on the trailing section, so that the trailing section has more teeth than the leading section;

inserting a short, tubular metal blank, having a leading end portion, a trailing end portion, and an intermediate portion therebetween, within the open ended tubular die entry end;

inserting the punch into the die entry end with the punch extension extending through the blank and the punch extension leading section positioned within the die throat;

moving the punch longitudinally towards the die throat to push the blank leading end portion through the die throat and around the punch leading end section and, thereby, collapsing radially inwardly, the blank leading end portion around the punch leading section and forming at least one interior channel within the blank leading end portion, corresponding to the number of teeth formed on the punch leading end section;

continuing moving the punch until its trailing end portion is arranged within the die throat and correspondingly moving the blank intermediate portion through the die throat and around the punch extension trailing end section and, thereby, continuing the formation of the channel formed by the punch leading end section while also forming at least one separate channel, corresponding to the number of additional teeth formed on the punch trailing section, in the blank intermediate portion;

removing the punch and positioning a second blank within the die with its leading end portion arranged against the trailing end portion of the first mentioned blank;

placing the punch into the die with its leading end section arranged within the die throat and within the trailing end portion of the first mentioned blank, and moving the punch towards the throat so that its shoulder pushes the second blank towards the throat to correspondingly push the first mentioned blank trailing end portion completely through the die throat for simultaneously forming a continuation of the longitudinally aligned channels formed in both the blank leading end portion and intermediate portion, and discontinuing the formation of any additional channel that was formed in the blank intermediate portion by the additional tooth on the punch trailing section;

thereby forming a continuous, full length longitudinal channel in the sleeve and a partial channel located roughly in the middle portion of the sleeve.

7. A method as defined in claim 6, and including forming a number of teeth on the punch extension leading section which are aligned and continuous with a corresponding number of teeth on the punch trailing section, and a number of additional teeth only on the punch trailing section and, thereby, forming a number of full length channels and a number of partial length channels in the finished valve body sleeve extruded through the die throat.

* * * * *